US012774704B2

(12) United States Patent
Marrero

(10) Patent No.: US 12,774,704 B2
(45) Date of Patent: Oct. 27, 2026

(54) PIEZOELECTRIC HYDRAULIC PISTON PUMP

(71) Applicant: Lucas Marrero, New York, NY (US)

(72) Inventor: Lucas Marrero, New York, NY (US)

( * ) Notice: Subject to any disclaimer, the term of this patent is extended or adjusted under 35 U.S.C. 154(b) by 0 days.

(21) Appl. No.: 19/205,747

(22) Filed: May 12, 2025

(65) Prior Publication Data

US 2025/0347272 A1 Nov. 13, 2025

Related U.S. Application Data

(60) Provisional application No. 63/646,528, filed on May 13, 2024.

(51) Int. Cl.

| | |
|---|---|
| ***F04B 17/00*** | (2006.01) |
| ***F04B 35/04*** | (2006.01) |
| ***F04B 39/00*** | (2006.01) |
| ***F04B 43/04*** | (2006.01) |
| ***F04B 49/00*** | (2006.01) |

(52) U.S. Cl.

CPC ..... *F04B 17/003* (2013.01); *F04B 35/04* (2013.01); *F04B 39/0005* (2013.01); *F04B 43/046* (2013.01); *F04B 49/00* (2013.01)

(58) Field of Classification Search

CPC ..... F04B 35/04; F04B 39/0005; F04B 49/00; F04B 17/003; F04B 43/046

See application file for complete search history.

(56) References Cited

U.S. PATENT DOCUMENTS

| | | | | |
|---|---|---|---|---|
| 3,598,506 | A * | 8/1971 | O'Neill | F04B 43/095 417/383 |
| 4,333,434 | A * | 6/1982 | Brunais | F02M 41/16 123/498 |
| 4,471,256 | A * | 9/1984 | Igashira | H10N 30/874 239/584 |
| 8,133,041 | B2 * | 3/2012 | Ludlow | F04B 53/162 417/322 |
| 8,267,675 | B2 * | 9/2012 | Bai | F04B 43/04 417/413.2 |
| 10,648,303 | B2 * | 5/2020 | Romer | F04B 47/02 |
| 11,389,821 | B2 * | 7/2022 | Fliess | H10N 30/883 |
| 2004/0213690 | A1 * | 10/2004 | Chenoweth | F04B 15/08 417/415 |
| 2009/0031116 | A1 * | 1/2009 | Bai | G06F 9/3016 712/E9.028 |
| 2009/0281494 | A1 * | 11/2009 | Das | A61M 5/14276 604/132 |
| 2023/0279879 | A1 * | 9/2023 | Kreutmayr | F04B 49/002 60/422 |

FOREIGN PATENT DOCUMENTS

JP 59010178 A * 1/1984

* cited by examiner

*Primary Examiner* — Nathan C Zollinger
(74) *Attorney, Agent, or Firm* — Mark V. Loen

(57) ABSTRACT

The embodied invention is a piezoelectric hydraulic piston pump. There is a single inlet and a single outlet leading into a fluid chamber. The piston separates the chamber housing from the piezoelectric actuator from the fluid chamber. The controls are simplified to take full advantage of the precision movement of the invention. A pump controller sends a signal to a piezo driver which causes a piston to move which creates pressure and flow. The embodied piezoelectric hydraulic pump requires a high-force, large displacement material, operating at high-frequencies to generate sufficient pressure and flow to be useful in many applications.

13 Claims, 3 Drawing Sheets

PIEZOELECTRIC HYDRAULIC PISTON PUMP

RELATED APPLICATIONS

This application claims the benefit of provisional application No. 63/646,528 filed on May 13, 2024. The entire provisional application is incorporated by reference.

STATEMENT OF GOVERNMENT INTEREST

Not applicable.

BACKGROUND OF THE INVENTION

There have been previous attempts to design and manufacture a fluid pump using a piezoelectric actuator. The concept promises a compact, highly efficient pump that, due to its unique characteristics, can produce and control high-pressure fluid movement with great precision. This can mean pressures of thousands of pounds per square inch out of a pump no larger than a pint glass.

Many high-pressure pump designs, based on conventional centrifugal, diaphragm or piston pumps, have limitations in achieving high-pressure while maintaining precision. They are often driven by large electromechanical motors and require time to build a head of pressure. To deliver precise, high-pressure fluid with a convention pump requires the addition of control valves, accumulators, sensors, and control systems to coordinate the individual components.

The disclosed invention uses a piezoelectric actuator as a piston with an extremely short stroke, run at high frequency, giving it instantaneous response characteristics. It avoids the lag time needed to build a full head of pressure. It eliminates the need of the ancillary equipment required to augment conventional high-pressure pumps in hydraulic systems requiring precision fluid movement. The invention can improve the performance of many different systems that are too small, or do not have enough power, for conventional high-pressure hydraulic pumps.

Previous piezoelectric actuator design attempts employ diaphragms which have a variety of limitations. First, they are optimized to produce flow but can only deliver a limited amount of pressure.

Since the motion of the piston is so small, ranging between 10 and 200 microns, tolerances in the device are extremely tight. It is difficult to get perfect alignment of the diaphragm and the piezoelectric actuator.

Existing designs require the actuator to be joined to the diaphragm with epoxy or other permanent adhesive. This joining method faces the difficulty of the actuator pushing the diaphragm up and down to create pressure differentials in the fluid chamber. This repetitive motion quickly fatigues the joint leading to failure. Also, the diaphragm deforms as it cycles though it's full range of motion. This creates a shearing force on the diaphragm and the epoxy joint, eventually leading to fatigue driven failure.

Even the slightest misalignment of the actuator in the pump housing can aggravate this situation. It also contributes to losses in displacement along the longitudinal axis and creates asymmetric loads on the actuator, reducing its lifespan.

Current designs are difficult to manufacture in large volumes. While they appear simple to bolt together, it is difficult to assemble with the levels of precision required to produce maximum performance. The length of the piezoelectric actuator and the pump housing and diaphragm have extremely tight tolerances. Again, since the displacement of the actuator is so small, achieving the correct distance between the top of the actuator and the diaphragm is critical and difficult. In current designs it is difficult to adjust for minute variations in piezoelectric stack dimensions and material properties. This complicates any volume production as it is impractical to add shims between the actuator and the pump housing, or to take other measures to attain the correct length.

Others have attempted to create a solid state pump that might include a piezoelectric actuator (U.S. Pat. No. 10,648,303 B2) connected to a piston as one option. Unfortunately, the piezoelectric design did not describe the piezoelectric properties needed that would avoid overheating, provide operational controls for a continuous pumping flow, and provide a sufficient flow/pressure curve that could be accepted in the marketplace.

Other piezoelectric pumps use diaphragms that are flexible and use a larger diameter to achieve a desired flow. However, is the flexible materials are unable to achieve higher output pressures. This means that the pump's capabilities are incapable of higher pressures. Also, the flexibility is undesirable because pressure output is subject to compression.

Previous designs require the user to have expertise in piezoelectric technology and the designs are not well suited for use outside of a laboratory. In a pump application, a user needs to control pressure, flow, and duty cycle; not frequency and voltage.

Heating is a significant issue in piezoelectric actuators. The piezoelectric material in the actuator has a defined curie temperature, effectively it's maximum operating temperature. When the actuator reaches that temperature, the material de-poles, it loses its piezoelectric characteristics, and ceases to function.

Actuator displacement is directly proportional to the voltage applied and operating frequency is proportional to flow rate. Unfortunately, high voltages and high operating frequencies cause the piezoelectric actuator to generate heat.

Heat causes other failures in the actuator, including failure of the bonding materials or conformal coating which will result in catastrophic failure of the actuator. The typical operating range of a piezoelectric pump is about −10° C. to +75° C. Overall, a more robust application of a piezoelectric pump to higher pressures and flows is reduced due to these failings.

What is needed in the art is a piezoelectric pump that will operate at a higher temperature and obtain a consistent higher pressure and flow.

SUMMARY OF THE INVENTION

The embodied invention is a piezoelectric hydraulic piston pump. There is a single inlet and a single outlet leading into a fluid chamber. The piston separates the chamber housing from the piezoelectric actuator and from the fluid chamber.

The controls are simplified to take full advantage of the precision movement of the invention. A pump controller sends a signal to a piezo driver which causes a piston to move and create pressure and flow.

The embodied piezoelectric hydraulic pump requires a high-force, large displacement material, operating at high-frequencies to generate sufficient pressure and flow to be useful in many applications. For example, the piezoelectric actuator must be able to displace 0.001% of its overall length and operate above 100 Hz, preferably at frequencies above 250 Hz for an hour without overheating. For this reason, a curie temperature of 350° C. or higher is needed for the piezoelectric actuator material.

DETAILED DESCRIPTION OF THE INVENTION

Figure 1:
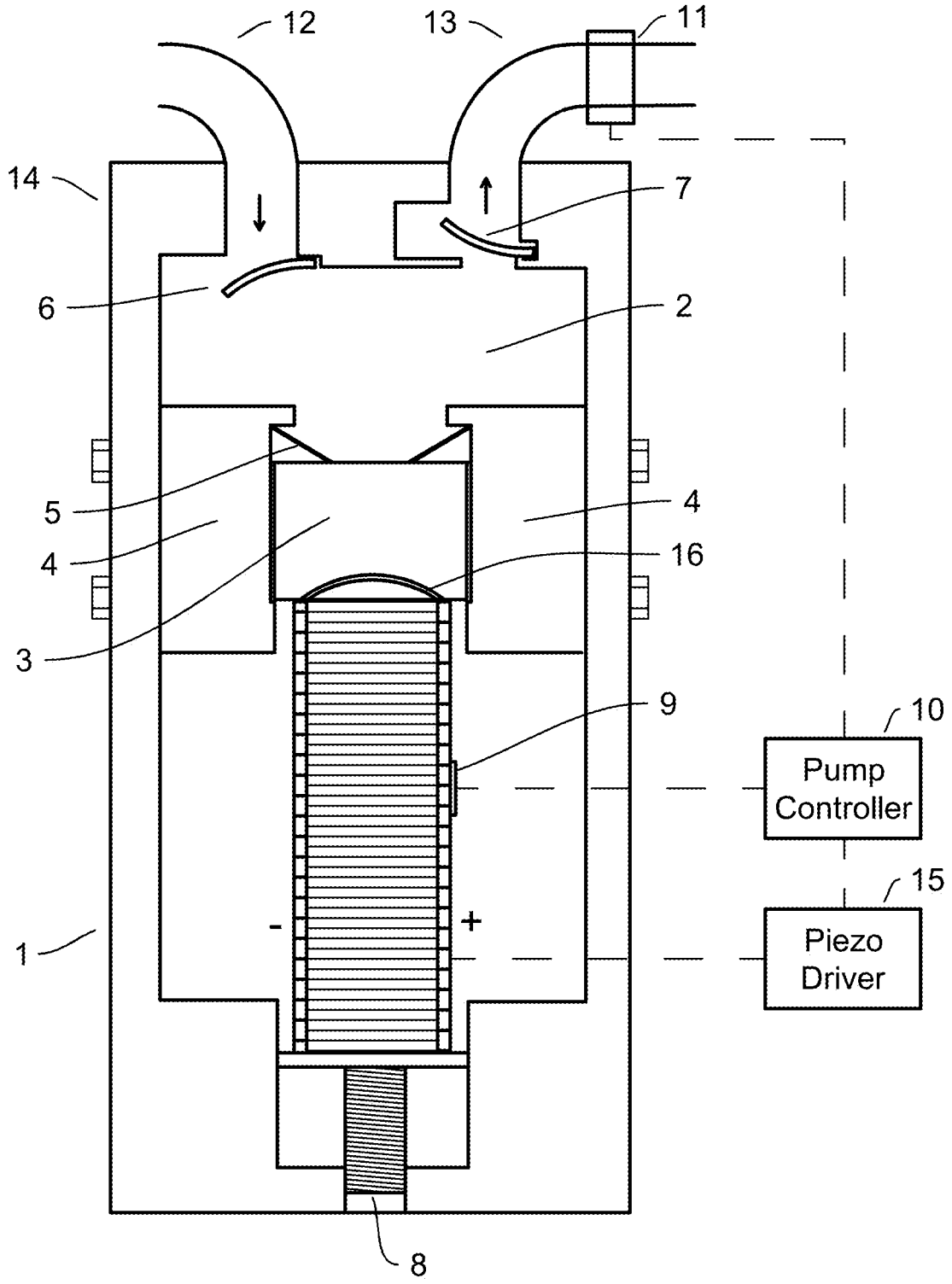
FIG. 1 is a top schematic view of the embodied piezoelectric pump.

The piston is preferably a simple piston inside a cylinder sleeve. Preferably, it is a precision matched piston/cylinder set, or a ceramic piston/cylinder set comprised of materials such as Hardened Stainless Steel and Zirconia. To self-seal, a 0.00005 diametrical clearance is needed between the piston and the cylinder sleeve. This provides a seal based on the precise fit of the piston to the cylinder. Alternately, at least one O-ring provides a seal between the piston and cylinder sleeve.

The piston is attached to the piezoelectric actuator with a ball/joint connection, reducing any minute asymmetrical loads on the actuator. A compression spring provides a force against the piston and actuator that facilitates the return of the piston on the downstroke.

An external screw adjustment at the base of the piezoelectric actuator moves the actuator up and down in the pump housing. This ensures the top of the actuator is at the correct height in the chamber.

The pump actuator is controlled by a piezoelectric driver, which sends out an AC variable voltage signal. This is often a sinusoidal waveform, and causes the piezoelectric actuator to lengthen and contract at different amplitudes and frequencies, in order to produce a precise pumping motion.

The embodied invention solves the issues of piezoelectric diaphragm pumps including:

1. Limited pressure generating potential of piezoelectric diaphragm pumps.
2. Performance losses and lifespan limitations attributed to misalignment of the piezoelectric actuator.
3. Sheering force problems associated with the diaphragm/actuator connection.
4. Piezoelectric actuator heat management and mitigation, which includes a piezoelectric material having a curie temperature above 350° C. Current practice is to limit the allowable temperature of a piezoelectric material to only 60% of the curie temperature, i.e. 210° C., to ensure actuator longevity. This is a large improvement over current equipment limited to 75° C.
5. Addressing manufacturing and maintenance challenges presented by the extremely small and precise motion of the actuator and overall design tolerances.
6. Simplifying the control input for ease of use by a user unfamiliar with piezoelectric devices.
7. Utilizing a pump controller with a microprocessor and a pressure/flow feedback loop to improve pump precision and useability.

The embodied invention is a piezoelectric hydraulic piston pump. There is a single inlet and a single outlet leading into the fluid chamber. The piston separates the chamber housing the piezoelectric actuator from the fluid chamber.

The piston can be a simple piston with a sealing ring or rings. It may also be a matched piston/cylinder set, or a ceramic piston/cylinder set comprised of materials such as alumina, hardened stainless steel and Zirconia. The latter option provides a seal based on the precise fit of the piston to the cylinder. It is attached to the piezoelectric actuator with a ball/joint connection, reducing any minute asymmetrical loads on the actuator. A compression spring provides a force against the piston and the actuator that aids in the return of the piston on the downstroke.

An external screw adjustment at the base of the piezoelectric actuator is used to move the actuator up and down in the pump housing to ensure the top of the actuator is at the correct height in the chamber.

The pump is controlled by a piezoelectric driver, an electronic unit that takes an electric current input and converts it to a voltage signal, often a sinusoidal waveform, that will cause the piezoelectric actuator to expand and contract at different amplitudes and frequencies producing a precise and highly controllable pumping motion.

Control inputs can be made to the driver through a variety of methods ranging from rheostat switches to software applications.

The driver includes a microprocessor that takes the difference between the frequency and voltage being applied to the actuator and the actual pressure and flow being produced and adjusts the drive signal to achieve the desired pressure and flow. An actuator temperature sensor prevents overheating.

Figure 2:
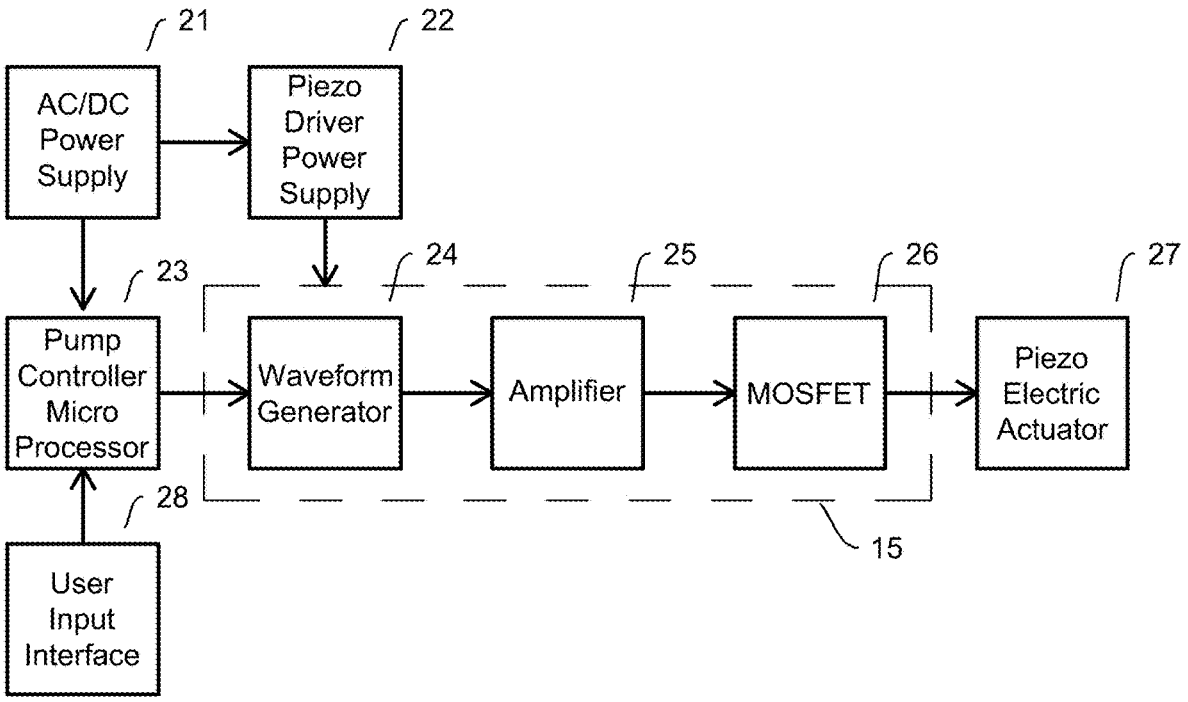
FIG. 2 is an electrical schematic of the piezoelectric pump control.
Figure 3:
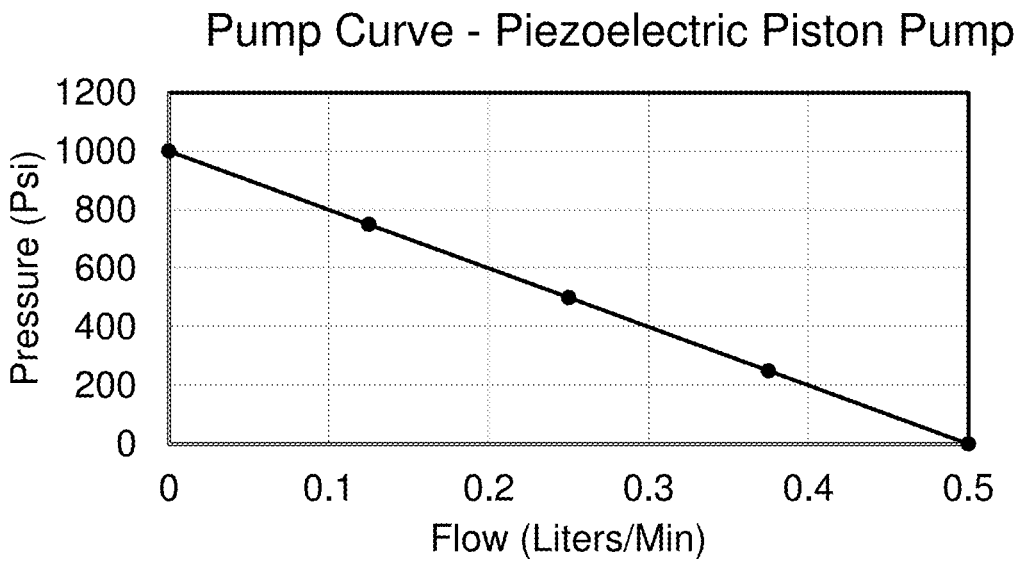
FIG. 3 is an exemplary pump curve.

The items shown in FIG. 1 are:

1 Piezoelectric Actuator
2 Fluid Chamber
3 Piston
4 Cylinder Sleeve
5 Tensioning Spring (Belleville Washer—Belleville Disc Spring Washer)
6 Inlet Valve
7 Outlet Valve
8 Tensioning Screw
9 Actuator Temperature Sensor
10 Pump Controller
11 Outlet Pressure/Flow Sensor
12 Inlet piping
13 Outlet Piping
14 Pump Casing
15 Piezo Driver
16 Hemispherical Shape Connection. The items shown in FIG. 2 are:
21 AC/DC Power supply
22 MOSFET Power Supply
23 Microprocessor Front End
24 Waveform Generator
25 Amplifier
26 MOSFET
27 Piezo Electric Coils
28 User Input Interface The parts shown in FIG. 1 are further described by:

1 The piezoelectric actuator functions as a micro-piston, expanding and contracting in response to the electric signal generated by the piezoelectric driver 15. The bottom end is flat and the top end is capped with a hemispherical shaped fitting 16 which represents the "ball" in the "ball and socket" that joins the actuator to the piston.

2 The fluid chamber is completely sealed when the inlet valve 6 and outlet valve 7 are closed and there is a perfect seal between the piston 3 and cylinder sleeve 4.

3 The piston has a hemispherical depression in the bottom matched to the hemispherical end on the piezoelectric actuator 1. The piston is composed of a high-grade metal, alumina, or a ceramic material such as zirconia or other hard ceramic, and is match ground or otherwise finished to mate with the cylinder sleeve 4 so that it prevents fluid intrusion into the pump chamber based on the fit.

4 The cylinder sleeve 4 is composed of a high-grade metal or ceramic material with a fit and finish matched to the piston 3 to seal the pump chamber from the section that houses the piezoelectric actuator 1.

5 The tension spring 5 is a disc spring or Bellville washer that maintains a pre-load on the piezoelectric actuator 1 and assists in returning the piston 3 to the retracted position when the piezoelectric actuator 1 contracts.

6 A passive or active valve that allows one-way flow from the inlet piping 12 to the fluid chamber. It can be a reed valve, a ball valve, or a piezoelectric valve.

7 A passive or active valve that allows one-way flow from the fluid chamber to the outlet piping 13. It can be a reed valve, a ball valve, or a piezoelectric valve.

8 A screw fitting accessible on the exterior of the pump housing allows a manufacturer or user to adjust tension on the piezoelectric actuator 1 after initial assembly or during the life of the unit. This is used to correct for minute differences in actuator length and tensioning spring 5 force. The tensioning screw may be held in place by a set screw.

9 A contact sensor that monitors the temperature of the piezoelectric actuator 1.

10 Pump controller. Separately, a pump controller incorporates a microprocessor to manage pump performance. The pump controller receives inputs from the temperature sensor 9 and outlet pressure/flow sensor 11 to prevent overheating of the piezoelectric actuator. It signals the piezo driver to change the voltage signal to produce the desired pressure and flow from the pump. The piezo driver regulates the actuator through a variety of methods ranging from rheostat switches to software programming.

11 The pressure/flow sensor is located downstream of the outlet valve 7, it monitors pressure and flow in the outlet piping, and transmits measurement signals to the piezo driver 15.

15 The piezo driver receives an electric power input and converts it to a high voltage signal, often a sinusoidal waveform, that will cause the piezoelectric actuator 1 to expand and contract at different amplitudes and frequencies.

The pump actuator is connected to the piezo driver 15 by two control wires that transmit the voltage signal to the piezoelectric actuator 1 and an additional wire or wires to connect the temperature sensor 9 to the piezo driver 15.

The piezoelectric actuator 1 is connected to two other components, the piston 3 and the tensioning screw 8. The connection between the piezoelectric actuator 1 and the piston 3 is a ball and socket style connection, where the hemispherical "ball" is secured to the top of the piezoelectric actuator 1, by epoxy or other permanent bonding mechanism and the hemispherical "socket" is molded or machined into, or otherwise attached to the base of the piston 3. This configuration ensures that the two surfaces are perfectly mated even if the piezoelectric actuator 1 is not perfectly straight and parallel due to slight manufacturing defects or imperfections in mounting within the pump housing.

A user inputs the desired pump performance into the pump controller. This can include pressure, flow rate, and duty cycle. The piezo driver 15 sends a voltage signal to the piezoelectric actuator 1 causing it to expand and contract, moving the piston 3 up and down in the cylinder sleeve.

Preferably, the temperature of the piezoelectric actuator is lowered by reducing the voltage or frequency created by the piezo driver. If needed, the pump can be turned off if the temperature becomes too high. In some demanding designs, it is necessary to include actuator cooling to prevent excessive heat buildup.

As the piezoelectric actuator 1 contracts, piston 3 moves down, causing a reduction in pressure in the fluid chamber. The higher-pressure fluid outside the fluid chamber 2 causes the inlet valve 6 to open, allowing the fluid to enter the chamber. As the piezoelectric actuator 1 expands, the piston 3 moves up, increasing pressure in the fluid chamber 2, causing the outlet valve 7 to open, allowing fluid to exit the chamber.

The piezo driver 15 will vary the voltage signal in amplitude and frequency to produce a range of motions in the piezoelectric actuator 1 resulting in different amounts of pressure and flow.

The temperature sensor 9 monitors the temperature of the piezoelectric actuator 1. In the event a predetermined temperature threshold is reached, the piezo driver 15 can reduce or stop the voltage or frequency going to the piezoelectric actuator 1 to prevent a depolarization of the material or other actuator failure.

A Pressure/Flow Sensor 11 sits downstream of the outlet valve 7. The sensor transmits actual pressure and flow being produced back to the pump controller 10 which, through use of a microprocessor, signals the desired pump adjustments, and signals the piezo driver to adjust the voltage and frequency being sent to the piezoelectric actuator 1 to meet the desired pressure, temperature, and flow output.

A piezoelectric hydraulic piston pump produces very high pressures from a pump with a small form factor, over 1,000 psi from a unit 4" in length and 2.5" in diameter. It achieves this with a piezoelectric actuator that displaces up to 120 microns per stroke, operating at up to 1,000 Hz. The short stroke, combined with the high frequency allow it to start and stop flow at maximum pressure virtually instantaneously. This makes the design highly effective at metering fluids at high pressure.

The piston assembly provides a smooth and precise pumping mechanism which allows the motion of the piezoelectric actuator 1 to be transferred to the fluid chamber with minimal losses. Furthermore, it minimizes lateral motion that could contribute to further losses and would result in asymmetric loading on the piezoelectric actuator 1 which reduces service life.

The ball and socket joint allows for more generous manufacturing tolerances of the piezoelectric actuator 1, which otherwise limits the ability to manufacture the pump in large numbers. Furthermore, it contributes to improved actuator life expectancy.

The tensioning screw 8 also allows for more generous manufacturing tolerances, specifically between the piezoelectric actuator 1 and the pump housing. Too much variance in these lengths will result in different pump performance across different pumps. This is important both for high volume manufacturing and adjusting for any changes in the other components such as the tensioning spring 5 of the pump over its lifecycle.

The temperature sensor and the microprocessor in the piezo driver 15 eliminate the possibility of de-poling the piezoelectric actuator 1 making the entire unit more practical for common use.

A microprocessor in the piezo driver 15 and in the pump controller 10 enables a user unfamiliar with piezoelectric technology to use the system. Inputs can be made in terms of pressure and flow rather than frequency and amplitude. The pressure/flow sensor 11 feedback loop increases the overall system precision in applications that require it, such as medical applications.

The piezoelectric driver preferably operates between 800 to 1000 volts to provide the best pump flow rate. Experience to date shows that voltages below 800 volts are unsatisfactory for commercial needs.

Similarly, it is preferable to operate the pump at 125 Hz or less to provide long term pumping capability without detrimental actuator heating. At frequency levels between 126-200 Hz actuator heating becomes a concern, and the need for actuator cooling becomes necessary. Cooling can be provided by cycles where the actuator is off or at a lower flow rate. It is possible to operate at a much higher frequency, as much as 20 kHz, if the actuator is liquid cooled. For small pumping systems, the addition of a liquid cooling system is undesirable.

In FIG. 2 the pump control is shown. The user inputs the desired pressure, flow, and on/off time cycle through the user interface 28 which inputs to the front-end pump controller with a microprocessor control 23.

The micro-processor control utilizes an embedded algorithm that translates pump pressure/flow/duty cycle to a frequency/voltage/pulse frequency. It then directs the waveform generator 24 to generate those parameters by the amplifier 25 and MOSFET 26 transistor(s). The piezoelectric actuator 27 receives the voltage/frequency/displacement and duty cycle to achieve the desired pressure/flow and on/off time according to the user interface direction.

As shown in FIG. 1, the exit pump pressure and flow sensor 11 provides a feedback loop to the pump controller.

The temperature sensor 9 monitors the temperature of the piezoelectric actuator and transmits that to the pump controller. The pump controller monitors that temperature in real-time. If the actuator temperature passes above a safe operating temperature, dictated by the curie temperature of the material, or detects heat building up in the actuator at an accelerated rate, the controller can command the waveform generator to reduce the frequency, voltage and current going being sent to the piezoelectric actuator, reducing the heat being generated in the systems before it can result in de-poling of the material or other catastrophic failure.

The curie temperature is the temperature at which a piezoelectric material will lose its dynamic properties. Typically, a piezoelectric actuator runs at 60% of its curie temperature, but it can intermittently run higher than that, or continuously if it is cooled.

The Piezoelectric actuator generates heat because of intermolecular friction and the absorption of energy. As with most ceramic materials, it does not dissipate heat well.

Optional methods of dissipating actuator heat include the use of heat sinks and liquid cooling systems. The latter can use a dedicated coolant loop, or by the fluid being pumped.

When the individual features are combined, the result is a compact hydraulic pump capable of producing exceedingly high pressures for its size. It has instantaneous on/off functionality for a broad range of applications.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

The invention claimed is:

1. An improved piezoelectric hydraulic piston pump comprising:

A) a pump housing;

B) a cylinder sleeve positioned in said pump housing;

C) a piezoelectric actuator connected to a piston inside said cylinder sleeve, said piston being movable relative to an enclosed fluid chamber;

D) said piezoelectric actuator utilizing a piezoelectric material having a Curie temperature above 350 degrees C.;

E) a ball-and-socket style connection between said piezoelectric actuator and said piston, said ball-and-socket style connection comprising a hemispherical ball secured to a top end of said piezoelectric actuator and received in a corresponding hemispherical socket in a base of said piston;

F) said piston is movably connected to said enclosed fluid chamber, said piston connected to a tensioning spring comprising a Belleville washer or Belleville disc spring washer, said tensioning spring maintaining a preload on said piezoelectric actuator and assisting return of said piston when said piezoelectric actuator contracts;

G) said enclosed fluid chamber is connected to an inlet pipe and an outlet pipe;

H) a one-way inlet valve hydraulically positioned between said inlet pipe and said enclosed fluid chamber;

I) a one-way outlet valve hydraulically positioned between said outlet pipe and said enclosed fluid chamber;

J) a tensioning screw connected to an end of said piezoelectric actuator and accessible from an exterior of said pump housing, said tensioning screw being operable to move said piezoelectric actuator up and down in said pump housing to adjust a position of said piston relative to said cylinder sleeve;

K) said tensioning screw connected to said pump housing;

L) an actuator temperature sensor connected to said piezoelectric actuator;

M) a piezoelectric driver electrically connected to said piezoelectric actuator and configured to provide a variable voltage signal to said piezoelectric actuator;

N) a pump controller electrically connected to said piezoelectric driver;

O) said pump controller electrically connected to a sensor that monitors outlet flow and outlet pressure and is located downstream of said one-way outlet valve in said outlet pipe, said sensor transmitting said outlet pressure and said outlet flow measurements to said pump controller;

P) wherein said pump controller is configured to signal said piezoelectric driver to adjust voltage and frequency of said variable voltage signal to produce a desired said outlet flow and a desired said outlet pressure; and Q) wherein said pump controller is further configured to reduce or stop voltage or frequency supplied to said piezoelectric actuator when said actuator temperature sensor indicates that a predetermined temperature threshold has been reached or that heat is building up in said piezoelectric actuator.

2. The piezoelectric hydraulic piston pump according to claim 1, wherein said hemispherical ball is secured to said top end of said piezoelectric actuator by a permanent bonding mechanism, and said corresponding hemispherical socket is molded, machined, or otherwise attached to said base of said piston.

3. The piezoelectric hydraulic piston pump according to claim 1, wherein said piezoelectric driver operates said piezoelectric actuator at 800-1000 volts.

4. The piezoelectric hydraulic piston pump according to claim 1, wherein said piezoelectric driver operates said piezoelectric actuator at 125 Hz or less.

5. The piezoelectric hydraulic piston pump according to claim 1, wherein said piezoelectric driver operates said piezoelectric actuator at 126-200 Hz with during reduced-duty operation.

6. The piezoelectric hydraulic piston pump according to claim 1, wherein a clearance tolerance between said cylinder sleeve and said piston is 0.00005 inches.

7. The piezoelectric hydraulic piston pump according to claim 1, wherein at least one O-ring provides a seal between said piston and said cylinder sleeve.

8. The piezoelectric hydraulic piston pump according to claim 6, wherein said piezoelectric actuator is hydraulically separated from said enclosed fluid chamber by said clearance tolerance.

9. The piezoelectric hydraulic piston pump according to claim 1, whereby said desired outlet fluid flow varies from 0 to 2 liters/minute.

10. The piezoelectric hydraulic piston pump according to claim 9, whereby said desired outlet pressure varies from 1000 to 0 psi according to a linear pump curve.

11. The piezoelectric hydraulic piston pump according to claim 1, wherein said piezoelectric actuator is configured to displace at least 0.001% of an overall length of said piezoelectric actuator and operate above 100 Hz for one hour without overheating.

12. The piezoelectric hydraulic piston pump according to claim 1, wherein said piezoelectric hydraulic piston pump is configured to produce an outlet pressure topping 1,000 psi, wherein said piezoelectric hydraulic piston pump has a length not greater than 4 inches and a diameter not greater than 2.5 inches, and wherein said piezoelectric actuator is configured to displace up to 120 microns per stroke while operating at a frequency up to 1,000 Hz.

13. The piezoelectric hydraulic piston pump according to claim 9, wherein said piezoelectric hydraulic piston pump is configured to operate according to a substantially linear pump curve extending from about 1,000 psi at about 0 liters per minute to about 0 psi at about 0.5 liters per minute.

* * * * *